US006867167B1

(12) United States Patent
Christen et al.

(10) Patent No.: US 6,867,167 B1
(45) Date of Patent: Mar. 15, 2005

(54) RECORDING MEDIUM WITH COLORED IMAGE INFORMATION AND METHOD OF PRODUCING A RECORDING MEDIUM

(75) Inventors: Paul Christen, Aarau (CH); Stephan D. Hofstetter, Niedererlinsbach (CH)

(73) Assignee: TRUB AG (CH)

( * ) Notice: Subject to any disclaimer, the term of this patent is extended or adjusted under 35 U.S.C. 154(b) by 0 days.

(21) Appl. No.: 09/979,894

(22) PCT Filed: Mar. 9, 2000

(86) PCT No.: PCT/CH00/00138

§ 371 (c)(1),
(2), (4) Date: Nov. 26, 2001

(87) PCT Pub. No.: WO00/73088

PCT Pub. Date: Dec. 7, 2000

(30) Foreign Application Priority Data

May 27, 1999 (CH) ..... 989/99
Aug. 17, 1999 (CH) ..... 1501/99

(51) Int. Cl.[7] ..... B41M 5/035; B41M 5/38
(52) U.S. Cl. ..... 503/227; 428/32.39
(58) Field of Search ..... 8/471; 428/32.39; 503/227

(56) References Cited

U.S. PATENT DOCUMENTS 4,579,754 A 4/1986 Maurer et al. ..... 428/29
5,350,198 A 9/1994 Bernecker ..... 283/77
5,435,599 A 7/1995 Bernecker ..... 283/70
5,753,589 A * 5/1998 Takao et al. ..... 503/227
5,846,900 A * 12/1998 Reiter et al. ..... 503/227
5,932,053 A * 8/1999 Asajima et al. ..... 156/233
6,004,900 A * 12/1999 O'Brien ..... 503/227
6,066,594 A * 5/2000 Gunn et al. ..... 503/227

FOREIGN PATENT DOCUMENTS

| | | |
|---|---|---|
| DE | 3151407 | 10/1983 |
| DE | 4134539 | 4/1993 |
| DE | 4417343 | 12/1995 |
| EP | 0 407 615 A1 | 1/1991 |
| EP | 0 431 564 A2 | 6/1991 |
| EP | 0 442 762 A2 | 8/1991 |
| EP | 0430282 | 10/1995 |
| EP | 0 743 192 A1 | 11/1996 |
| GB | 2250951 | 6/1992 |
| WO | WO 94/15319 A1 | 7/1994 |
| WO | 9819870 | 5/1998 |

* cited by examiner

*Primary Examiner*—B. Hamilton Hess
(74) *Attorney, Agent, or Firm*—Webb Ziesenheim Logsdon Orkin & Hanson, P.C.

(57) ABSTRACT

The invention relates to a recording medium provided with colored image information, notably an identification card or value card. The colored image information is applied to a surface (A) of a polycarbonate layer which is treated to give it adhesive properties. The colored image information is notably applied by means of a thermal method and the surface (A) is preferably treated by application of an adhesive coating.

19 Claims, 1 Drawing Sheet

RECORDING MEDIUM WITH COLORED IMAGE INFORMATION AND METHOD OF PRODUCING A RECORDING MEDIUM

CROSS-REFERENCE TO RELATED APPLICATION

This application is the national phase of PCT/CH00/00138, filed Mar. 9, 2000 and herein incorporated by reference in its entirety.

BACKGROUND OF THE INVENTION

The invention relates to a recording medium with colored image information, including but not limited to an identification card or credit card, debit card, phone card etc. Recording media of this type are widely used as, among other things, government identification cards, passports, transit passes, bank cards and credit cards. When such recording media are personalized, the personalization process includes the recording of the individual data, which can include but is not limited to personal data that relate specifically to the owner. An essential part of the personalization is the application of colored image information in the form of a photograph of the person to be identified.

There are numerous possible ways to apply colored images to recording media. The methods disclosed in the prior art include transfer processes in which inks are transferred to the medium from ink media by thermal sublimation or thermal diffusion. The prior art also discloses the application of colored image information using ink-jet devices, thermal printing or color laser printing.

To make such colored image information very difficult to counterfeit, the prior art discloses methods to transfer a colored image to the medium so that the colors diffuse into the plastic medium and are thus difficult to remove. DE 4134539 also discloses the division of the image information into at least two information parts. In this case, one part is a color part and the other part is a black and white part.

Identification cards with a colored image portion have also been disclosed in DE 4134539 and DE 4417343.

SUMMARY OF THE INVENTION

The prior art also describes the application of information by means of a laser printer. In this regard, reference is made to DE 3151407. Currently, color photographs using the thermal printing or thermal sublimation methods are transferred to media made of PVC or PET or combinations of different plastics. However, such plastics have the disadvantage that they age relatively quickly and can be bent at temperatures above 80° C. A plastic made of polycarbonate would be more suitable for use as a medium. Polycarbonate plastic has significantly greater durability than PVC and is also significantly more resistant to high temperatures. In the prior art, however, it has not been possible to personalize a medium made of polycarbonate by applying colored image information by means of a thermal process.

The object of the invention is to create a recording medium of the type described above that has significantly greater durability than PVC and that can be personalized with colored image information, in particular by means of thermal printing or thermal sublimation.

The invention provides a recording medium of the general type described above but in which the colored image information is applied to a surface of a polycarbonate layer that has been treated to improve its adhesive properties. An important aspect of the invention is that as a result of the treatment of the surface of a polycarbonate layer, colored information can be applied to this layer. Among other things, it has been determined that a treated medium can be printed by means of a thermal process.

One treatment that is particularly well suited for the accomplishment of this objective, as disclosed by one development of the invention, is that a lacquer is applied to the above mentioned polycarbonate surface to improve its adhesive properties. One lacquer that is particularly well suited for this process is a screen printing lacquer, in particular a screen printing lacquer that contains a solvent. A lacquer of this type penetrates into the plastic and modifies the molecules in the areas close to the surface so that dyes applied during the thermal process penetrate into the polycarbonate and adhere to it. In particular, thermal printing films can be used for this process. Thermal printing processes can also be used in which the pins used for the printing penetrate into the plastic, analogous to the methods used to print on PVC.

The invention additionally relates to a method for the production of a recording medium with colored image information, such as but not limited to an identification or credit card, debit card, phone card etc. The method is includes a first process step in which a medium is manufactured from polycarbonate. In a second step, a surface of this medium is treated to improve its adhesive properties. In a third step, the colored image information is applied to the treated surface. The information is preferably applied by means of a thermal process and, in one embodiment, by means of thermal sublimation or thermal transfer. To improve its adhesive properties, the medium is preferably coated with lacquer, preferably by means of a screen printing lacquer.

One advantage of the invention over other known processes is that even with the greater durability of the recording medium, an aesthetically very high-quality color image can still be produced. Because the inks used in the thermal process penetrate into the medium, a high degree of security is also guaranteed. An additional advantage of the invention is that the surface that is treated to improve its adhesive properties also significantly facilitates the application of a protective coating. A protective coating of this type is preferably again a lacquer, in particular a screen printing lacquer.

Additional advantageous features are described in the appended claims, the description presented below and in the accompanying drawings.

BRIEF DESCRIPTION OF THE DRAWINGS

One exemplary embodiment of the invention is explained in greater detail below with reference to the accompanying drawings, in which.

DESCRIPTION OF THE PREFERRED EMBODIMENTS

Figure 1:
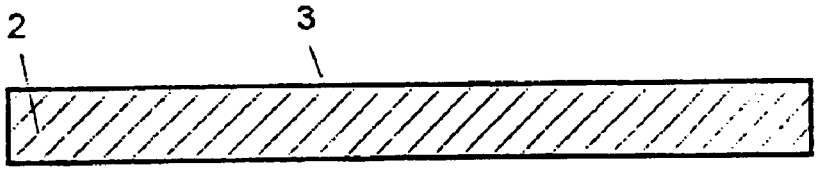
FIGS. 1 to 5 are schematic illustration for the individual process steps on the basis of respective sections through a medium.

FIG. 1 shows a base medium 2 which has been manufactured from polycarbonate and which preferably has a flat upper surface 3. The base medium can include one or more layers, i.e. it can also be a laminate.

Figure 2:
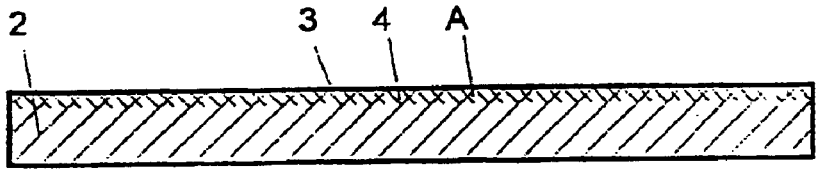
Figure 3:
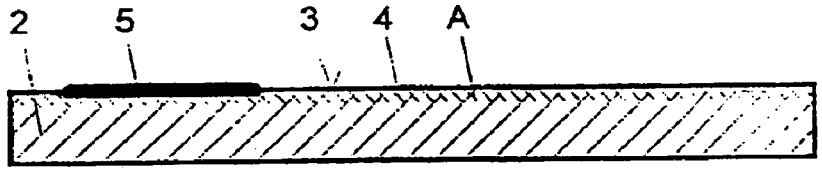
Figure 4:
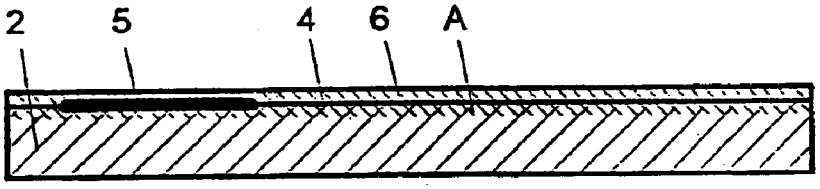
Figure 5:
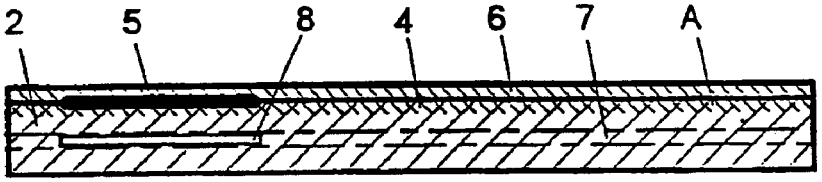

The base medium 2 is treated in at least one area of the upper side 3 to improve its adhesive properties. For this purpose, a lacquer 4 is applied which, as illustrated in FIG. 2, covers at least a portion of the upper side 3. The lacquer 4 can be a screen printing lacquer, such as a screen printing lacquer that contains a solvent. This lacquer 4 can be applied in any conventional manner, such as those described in the prior art. A screen printing lacquer that is particularly well suited for the practice of the invention is marketed by the firm of Siebdruckbedarf AG in Erlinsbach (Switzerland) under the name PVC 70/2110. A lacquer 4 of this type penetrates into the base medium 2 and modifies the molecular structure on the surface of the base medium 2. This layer is designated A in FIG. 2.

On the treated base medium 2, colored image information 5 is applied, such as in the form of a color image. The method used in this case is a thermal process, such as a conventional thermal sublimation or thermal transfer process of the prior art. In this method, films which are called "thermal transfer films" are used, and as a result of the application of heat, the inks penetrate into the area designated A.

After the application of the colored image information 5, at least the area that contains this image information 5 is covered with a protective coating 6. This protective coating can again be a screen printing lacquer, which adheres particularly well on account of the above-mentioned treatment. A screen printing lacquer that is particularly well suited for use as a protective coating in the practice of the invention is marketed by the firm of Siebdruckbedarf AG in Erlinsbach (Switzerland) under the name PVC 70/70.

As an additional optional step, a black-and-white portion 8 can be introduced into the base medium 2 by means of a conventional laser printer of the prior art. This portion 8 is introduced into a layer 7 so that it is congruent with the colored image information 5. This layer 7 is provided in the manner of the prior art with an additive, such as a carbon black, for example. A black-and-white portion 8 of this type is not mandatory. However, it further improves security. During the manufacture of the portion 8 by means of a laser printer, the colored image information 5 is preserved. The information 5 can be, among other things, a color full-page image.

Figure 6:
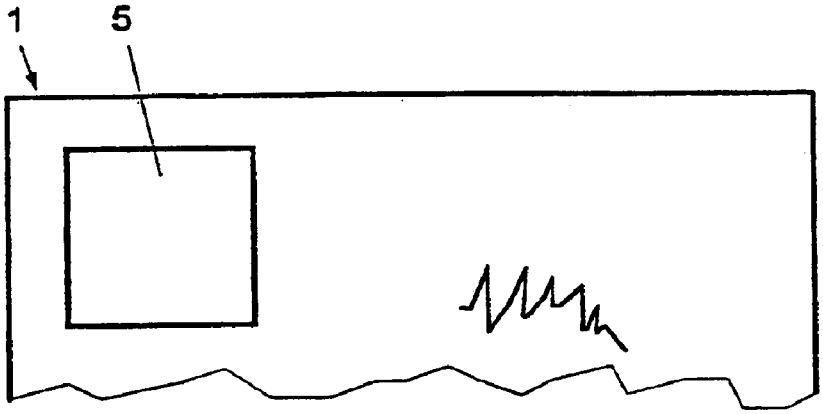
FIG. 6 is a schematic illustration of a partial view of a recording medium.

FIG. 6 shows a recording medium 1 of the invention which is provided for personalization with visible colored image information 5 in the form of an image. For personalization, it goes without saying that there can also be additional information, such as a signature, for example. This additional information can likewise be applied using a thermal process. However, it is also possible to apply such-information by means of a laser printer, for example. The recording medium 1 is preferably made mostly or entirely of a polycarbonate. The result is a highly durable medium with a useful life of ten years or longer, for example, as well as resistance to temperatures up to approximately 150° C. The colored image information 5 is characterized by particularly sharp contours. The disposal of the recording medium poses no environmental problems, because polycarbonate can be incinerated without producing hazardous pollutants or byproducts.

It will be readily appreciated by those skilled in the art that modifications can be made to the invention without departing from the concepts disclosed in the foregoing description. Accordingly, the particular exemplary embodiments described in detail herein are illustrative only and are not limiting to the scope of the invention, which is to be given the full breadth of the appended claims and any and all equivalents thereof.

What is claimed is:

1. A recording medium in the form of a credit card, a debit card, or a phone card with colored image information, the recording medium comprising:

a polycarbonate surface treated to improve its adhesive properties, wherein the molecules in the area close to the polycarbonate surface are modified by a lacquer penetrated into the polycarbonate surface; and colored image information applied by means of a thermal process to the treated surface.

2. The recording medium as claimed in claim 1, wherein the colored image information is applied by thermal sublimation.

3. The recording medium as claimed in claim 1, wherein the lacquer is a screen printing lacquer.

4. The recording medium as claimed in claim 3, wherein the lacquer is a screen printing lacquer that contains a solvent.

5. The recording medium as claimed in claim 1, wherein at least the colored image information is covered with a protection coating.

6. The recording medium as claimed in claim 5, the protection coating is a film or a lacquer coating.

7. The recording medium as claim in claim 6, wherein the lacquer coating is a screen printing lacquer.

8. The recording medium as claimed in claim 7, wherein the lacquer is a screen printing lacquer that contains a solvent.

9. The recording medium as claimed in claim 1, including a black-and-white portion located under or over the colored image information.

10. The recording medium as claimed in claim 9, wherein the black-and-white portion is applied by a laser printer with complete preservation of the colored image information.

11. The recording medium as claimed in claim 9, wherein the colored image information and the black-and-white portion are located congruently one above the other and at a distance from each other.

12. The recording medium as claimed in claim 1, wherein the recording medium is selected from the group consisting of an identification card, a credit card, a debit card, and a telephone card.

13. A method for manufacturing a recording medium in the form of a credit card, a debit card, or a phone card with colored image information, comprising the steps of:

providing a medium comprising polycarbonate;

treating a polycarbonate surface of the medium to improve its adhesive properties wherein a lacquer is applied to this surface and penetrates into the polycarbonate surface and modifies the molecules in the area close to the surface; and applying a colored image information by a thermal process onto the treated surface.

14. The method as claimed in claim 13, wherein the thermal process for applying the colored image information onto the treated surface includes thermal sublimation or thermal transfer.

15. The method as claimed in claim 13, wherein the lacquer is a screen printing lacquer.

16. The method as claimed in claim 15, wherein the lacquer is a screen printing lacquer that contains a solvent.

17. The method as clamed in claim 13, including applying a protective coating over at least the colored image information.

18. The method as claimed in claim 17, wherein the protective coating is a film or a lacquer coating.

19. The method as claimed in claim 18, wherein the lacquer coating is a screen printing lacquer.

* * * * *

UNITED STATES PATENT AND TRADEMARK OFFICE

CERTIFICATE OF CORRECTION

PATENT NO. : 6,867,167 B1
DATED : March 15, 2005
INVENTOR(S) : Christen et al.

It is certified that error appears in the above-identified patent and that said Letters Patent is hereby corrected as shown below:

Column 1,
Line 42, before the third complete paragraph, delete "SUMMARY OF THE INVENTION".
Line 62, after the third complete paragraph, insert -- SUMMARY OF THE INVENTION --.

Column 4,
Lines 22-23, "the protection coating" should read -- wherein the protection coating --.

Signed and Sealed this

Twenty-seventh Day of September, 2005

JON W. DUDAS
*Director of the United States Patent and Trademark Office*